US006718779B1

(12) United States Patent
Henry

(10) Patent No.: US 6,718,779 B1
(45) Date of Patent: Apr. 13, 2004

(54) METHOD TO OPTIMIZE CHILLER PLANT OPERATION

(76) Inventor: William R. Henry, 5918 Silver Leaf Rd., San Jose, CA (US) 95138

( * ) Notice: Subject to any disclaimer, the term of this patent is extended or adjusted under 35 U.S.C. 154(b) by 65 days.

(21) Appl. No.: 10/179,366

(22) Filed: Jun. 25, 2002

Related U.S. Application Data

(60) Provisional application No. 60/339,586, filed on Dec. 11, 2001.

(51) Int. Cl.[7] ..... F25B 39/04
(52) U.S. Cl. ..... 62/183; 62/305
(58) Field of Search ..... 62/183, 305, 121, 62/99, 230

(56) References Cited

U.S. PATENT DOCUMENTS

| | | | | |
|---|---|---|---|---|
| 4,085,594 A | | 4/1978 | Mayer | 62/171 |
| 4,210,957 A | | 7/1980 | Spethmann | 364/105 |
| 4,252,751 A | | 2/1981 | Shito | 261/26 |
| 4,325,223 A | | 4/1982 | Cantley | 62/126 |
| 4,463,574 A | | 8/1984 | Spethmann | 62/175 |
| 4,474,027 A | | 10/1984 | Kaya et al. | 62/171 |
| 4,483,152 A | | 11/1984 | Bitondo | 62/175 |
| 4,554,964 A | | 11/1985 | Awano | 165/39 |
| 5,040,377 A | | 8/1991 | Braun | 62/183 |
| 5,050,394 A | * | 9/1991 | Dudley et al. | 62/115 |
| 5,070,704 A | | 12/1991 | Conry | 62/175 |
| 5,097,670 A | | 3/1992 | Yoshikawa | 62/99 |
| 5,138,844 A | | 8/1992 | Clanin | 62/89 |
| 5,222,370 A | | 6/1993 | James | 62/175 |
| 5,600,960 A | | 2/1997 | Schwedler | 62/99 |
| 5,946,926 A | | 9/1999 | Hartman | 62/201 |
| 5,963,458 A | | 10/1999 | Cascia | 364/528.35 |
| 5,970,724 A | | 10/1999 | Weng | 62/121 |
| 6,047,555 A | * | 4/2000 | Weng | 62/171 |
| 6,185,946 B1 | | 2/2001 | Hartman | 62/175 |
| 6,257,007 B1 | | 7/2001 | Hartman | 62/183 |
| 6,446,448 B1 | | 9/2002 | Wang et al. | |

OTHER PUBLICATIONS

SA–96–12–3 1996 Redden, George H. ASHRAE Transactions "Effect of Variable Flow on Centrifugal Chiller Performance".

* cited by examiner

*Primary Examiner*—Melvin Jones

(57) ABSTRACT

A chiller plant which produces chilled water for airconditioning, or an industrial process and which is comprised of chillers, cooling fluid pumps, and cooling towers with electrical motor drives uses a substantial amount of energy. A method that coordinates the operation of the cooling tower, cooling fluid pumps, and refrigeration machines so that the chiller plant operates at a higher overall efficiency thus reducing the power usage has been developed and is presented herein. The flow rate of the cooling fluid pumps are controlled to maintain a precise temperature difference across the refrigerant condenser. The cooling tower fans are controlled by comparing the cooling fluid temperature and the cooling fluid flow rate to selected design parameters. The heat rejection rate is measured for each chiller in the chiller plant and operating set points are established for each operating chiller to provide the optimum operation for best energy efficiency.

17 Claims, 5 Drawing Sheets

METHOD TO OPTIMIZE CHILLER PLANT OPERATION

This application is entitled to the benefit of Provisional Patent Application Ser. No. 60/339,586 filed Dec. 11, 2001.

FEDERALLY SPONSORED RESEARCH

Not Applicable

SEQUENCE LISTING OR PROGRAM

Not Applicable

BACKGROUND—FIELD OF INVENTION

This invention relates to a chiller plant, and specifically methods of operation that will reduce the power usage and improve the plants efficiency.

BACKGROUND—DISCUSSION OF PRIOR ART

A chiller plant as shown in FIG. 1, includes a chiller (5), a cooling fluid pump (1), a cooling tower (3), and a cooling fluid piping circuit (11) which interconnects these pieces of equipment. The chiller plant produces a chilled fluid that is distributed in a chilled fluid piping circuit (12).

The chiller plant may also include a plurality of chillers, pumps, and cooling towers. For instance multiple chillers can be operated in parallel, with a single cooling fluid piping circuit connecting all chillers to the same cooling tower. Another system shown in FIG. 2 has a separate fluid cooling circuit, and separate cooling tower for each individual chiller in the chiller plant.

The chiller (5) is a refrigeration machine that chills water or other fluid mediums to a controlled temperature level. It is a complete unit consisting of a refrigerant condenser (4), a refrigerant evaporator (10), a refrigerant compressor (9), a chiller control panel (8), and an electric motor drive (7). The chiller (5) is typically provided as a single package by one manufacturer. The cooling tower (3), cooling fluid pump (1), and cooling fluid piping circuit (11) constitutes a heat rejection system for the chiller plant. The cooling tower (3) can have one fan (6) or a plurality of fans. The cooling tower (3) fans (6) and the cooling fluid pump (1) have electric motor drives (7). The electric motor drives (7) may be constant speed or variable speed.

The Cooling fluid pump (1) forces a cooling fluid (2) to circulate from the cooling tower (3) to the refrigerant condenser (4) of the chiller (5) and back to the cooling tower (3). When chiller (5) is operating pump (1) operates at a constant flow rate. Fan (6) for cooling tower (5) also operates independently of the chiller.

The chiller, the cooling tower fan, and the cooling fluid pump all have control systems that are independent of each other. During periods of operation, when the chiller is operating at part load, the cooling tower fan, and the cooling fluid pump will be operating at full or a high and unnecessary power setting, thus wasting a substantial amount of energy. Since the chiller typically operates at part load for most of the time, the amount of wasted energy over time can be quite large.

The chilled fluid temperature is controlled by the chiller to a set temperature. The chiller set point can be adjusted by the chiller plant operator, either manually, or through an automatic control system provided for the plant. When loading levels on the plant are low, it can be desirable to reset the chilled fluid temperature to a higher level to reduce energy usage.

Various control systems have been applied in the past, which have automated portions of the chiller plant and it's heat rejection system. The automation was initially designed to eliminate manual control, then additional automation for better control and to save energy, which quickly becomes obsoleted with the availability of better instrumentation and computerized controllers.

FIG. 2 shows a chiller plant with a plurality of chillers, pumps and cooling towers. This depicts a method for controlling cooling fluid pumps, cooling tower fans, and chiller operations in a coordinated fashion to reduce energy usage.

A computerized controller (13) controls the speed of the electric motor drives (7) for the cooling tower fan (6), the cooling fluid pump (1), and chiller (5).

U.S. Pat. No. 6,257,007 to Hartman (2001), and U.S. Pat. No. 6,185,946 to Hartman (2001) describe methods similar to FIG. 2, where the system components of the chiller plant are controlled in response to the current loading level on the cooling system. The current loading level is always determined by specific chiller parameters such as power, or refrigerant head pressure, or motor speed. Therefore, these methods may require direct access to the selected chiller parameters. Since the chiller manufacturer normally does not provide for this type of access, it can only be implemented with the special help from the manufacturer.

U.S. Pat. No. 5,963,458 to Cascia (1999) describes a generic computer designed to use chiller load data derived from the chiller plus additional parameters that include wet bulb temperature, tower air flow rate, and condenser water flow rate. The computer then determines the optimal set point for operation of cooling tower fans, condenser water pumps, and chillers. The computer can be set up to provide set point operation to as many or as few components as desired. The electric motor drives can be either variable speed or constant speed. A large number of peripheral devices are required and the control sequence can only be implemented through this generic computer with a set of complicated and difficult to understand control algorithms. It can only be implemented with the help of highly trained specialists.

Another method for the control of the cooling fluid pump is disclosed in U.S. Pat. No. 5,070,704 to Conroy. A plurality of chillers are served by one cooling fluid pump. The chillers each have control valves which shut off cooling fluid flow when that chiller is off line. The cooling fluid pump has a variable speed electric motor which is controlled by way of a pressure sensor located in the cooling fluid circuit. This control has limited application in today's chiller plant that typically has separate pumps matched to each chiller.

A number of methods have been disclosed for the control of cooling tower fans. U.S. Pat. No. 4,085,594 to Mayer, (1978) controls fans in response to the temperature of the cooling fluid, as is also shown in and U.S. Pat. No. 4,252,751 to Shito, (1981). The principle intention was to automate the cooling tower control and eliminate man power. More efficient controls were introduced with U.S. Pat. No. 4,474,027 to Kaya, et al, (1984), which discloses the use of wet bulb temperature to optimize the speed of the cooling tower fans. Additional improvements in energy usage are introduced in U.S. Pat. No. 5,040,377 to Braun et al, (1991) and U.S. Pat. No. 5,600,960 to Schwedler et al, (1997), both include a means to determine the chiller load by measuring the temperature and flow rate of chilled fluid that enters and exits the evaporator, as well as a means for determining wet bulb temperature and cooling fluid temperature, then control the cooling tower fan to the desired speed. Multiple input parameters are required, which must be compared using multiple logic loops to finally determine the desired control output, making a complicated control regime, requiring highly trained specialists to implement.

Object and Advantages

Several objects and advantages of the present invention are:

(a) to provide method to maintain a constant, or near constant, temperature difference of the cooling fluid as it enters and exits the refrigerant condenser.

(b) to provide a method to control the flow rate of the cooling fluid to the refrigerant condenser.

(c) to provide a simple method to control the cooling tower fan speed based on the cooling fluid temperatures and cooling fluid flow rate.

(d) to provide a simple method to allow sequencing of a plurality chillers, and optimize combined energy efficiency of the operating chillers.

(e) to provide a method of control for condenser water pumps, and cooling tower fans of a chiller plant that has a constant speed chillers and variable speed chillers in the same plant.

(f) to provide a method of control that is simple to install and maintain.

(g) to provide a method of control that is flexible and adaptable to different chiller plant designs.

(h) to provide a method of control that does not require direct access to proprietary wiring and controls of a manufacturer's chiller.

(i) to provide a method of control that can be retrofitted to existing chiller plants.

Further objects and advantages are to provide a simple method of control that uses off the shelf components, can be provided as a stand-alone system without the support of a building automation system, can also be incorporated into major building automation systems, is flexible in the inclusion or exclusion of controlled components, does not require proprietary knowledge of chiller manufacturer's equipment, can be easily employed by the engineering and construction disciplines. Still further objects and advantages will become evident from a consideration of the ensuing description and drawings.

SUMMARY

In accordance with the present invention it provides a methodology for the control of chiller plants that will improve the combined system efficiency of the various pieces of equipment to improve the overall energy usage.

DRAWINGS

Drawing Figures

In the drawings, equipment components with the same equal function using the same equipment have the same number through out. Closely related components with similar functions will have the same number but different alphabetic suffixes.

Reference Numerals

Figure 1:
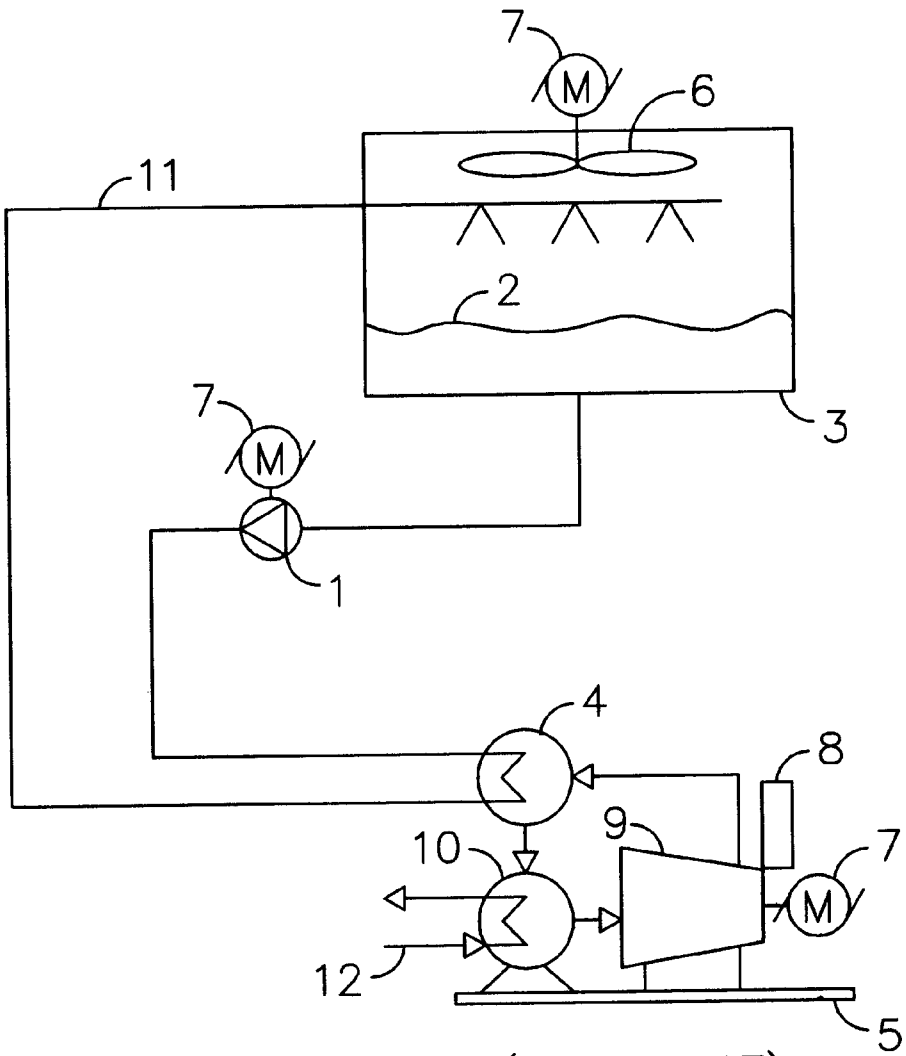
FIG. 1 (PRIOR ART)
FIG. 1 shows prior art which is a typical chiller plant installation where the chiller, cooling tower, and fluid cooling pump operate independently.
Figure 2:
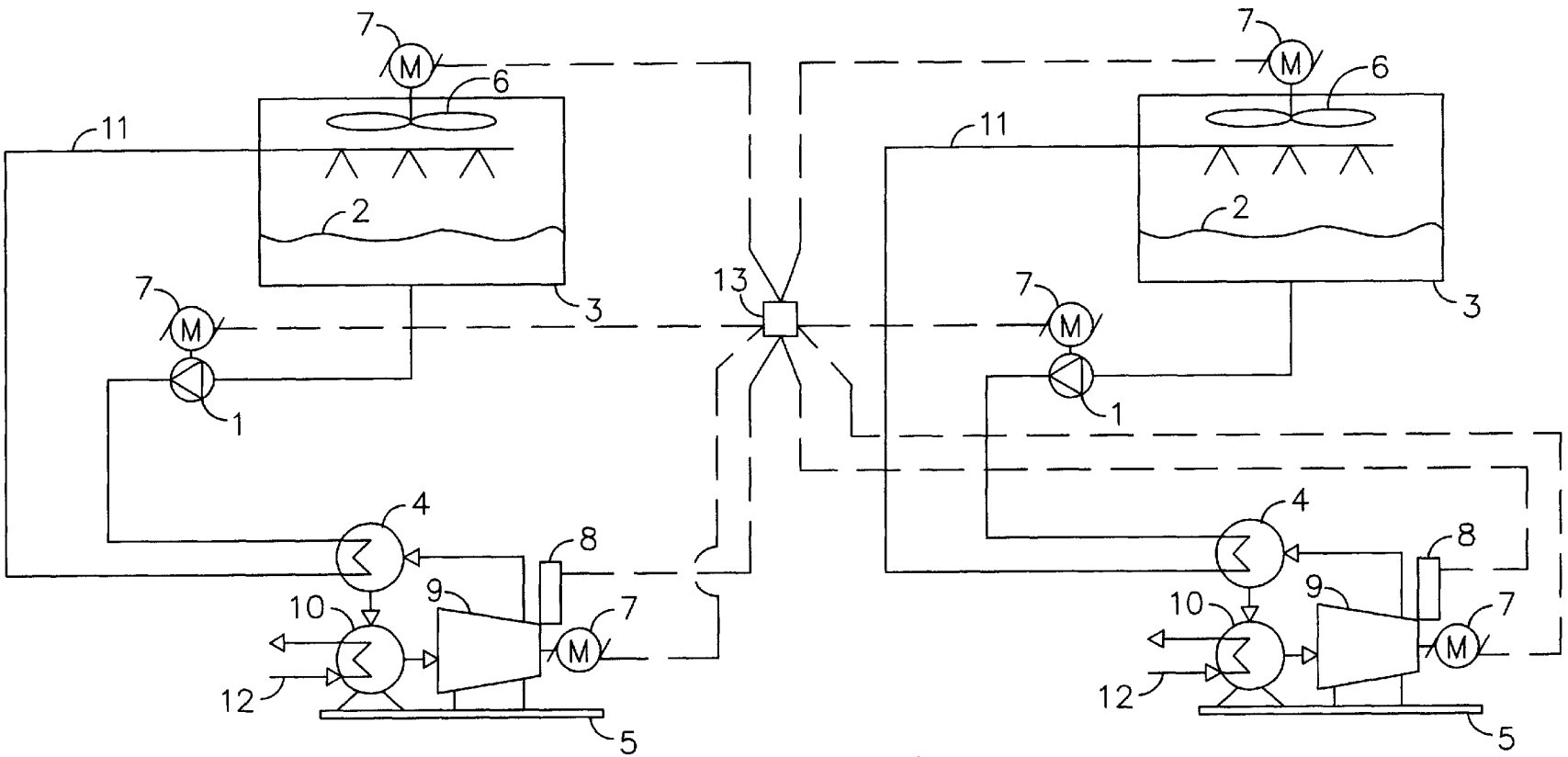
FIG. 2 (PRIOR ART)
FIG. 2 shows prior art with a plurality of chillers and equipment that have controls to coordinate the operation of all the equipment.

1 cooling fluid pump
2 cooling fluid
cooling tower
3 refrigerant condenser
4 chiller
5 fan
6 electric motor drive
7 chiller control panel
8 refrigerant compressor
9 refrigerant evaporator
10 cooling fluid piping circuit
11 chilled fluid piping circuit
12 computerized controller
13 temperature sensor
20 flow meter
22 temperature controller
23 instrument receiver
24 differential temperature transmitter
25*a* computerized controller with analog inputs, and outputs
25*b* computerized controller with added functionality

DESCRIPTION

Figure 3:
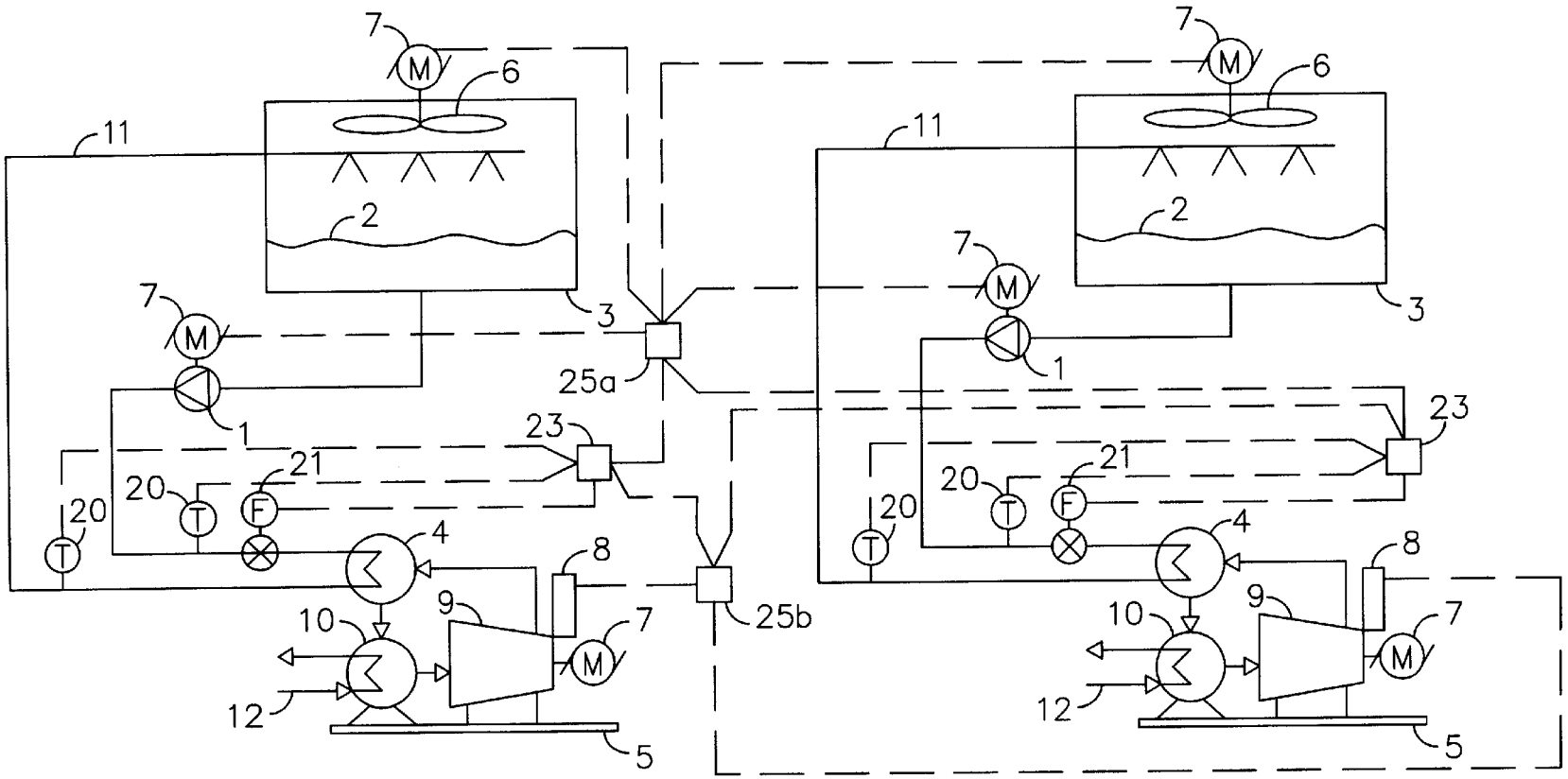
FIG. 3 shows the main embodiment of the invention that manages and controls the operation of cooling tower fans, cooling fluid pumps and sequences chillers in a multi-chiller plant.

Description—FIG. 3—Preferred Embodiment

The preferred embodiment of the, present invention is illustrated in FIG. 3. A chiller plant with a plurality of chillers, cooling fluid pumps and cooling towers with fans and a control system that manages the overall operation of the chiller plant to achieve the lowest energy usage and highest energy savings.

A matched pair of temperature sensors (20) are installed in the cooling fluid piping circuit (11) such that the entering cooling fluid temperature and the leaving cooling fluid temperature at the refrigerant condenser (4) are accurately measured. A flow meter (21) is installed in the cooling fluid piping so that it measures the flow rate thru the refrigerant condenser.

A BTU meter (23) receives the temperature signals from each temperature sensor (20) and the flow rate signal from the flow meter (21). An instrument receiver calculates the temperature difference, and if wanted BTU rate. The temperature difference signal, a BTU rate signal, fluid flow rate signal, and entering and leaving cooling fluid temperature signal made available to a computerized controller (25*a*).

The computerized controller (25*a*) will maintain the temperature difference, between the the entering cooling fluid temperature and the leaving cooling fluid temperature at the refrigerant condenser, to a constant value. This value, used as a set point, is typically the design temperature difference originally established by the chiller (5) manufacturer's design specification. The computerized controller (25*a*) compares the temperature difference signal to the set point temperature difference. Control output signals are then generated and sent to the variable speed electric motor (7) for the cooling fluid pump (1). The speed of the cooling fluid pump (1) is controlled to maintain the temperature difference across the refrigerant condenser (4). The cooling fluid pump (1) speed may be controlled directly in response to the temperature difference signal using a conventional "PID loop". The preferred manner of control for the cooling fluid pump speed will to establish a base flow rate based on design flow rate of the chiller then control to that flow rate with a conventional "PID loop", using the flow signal input from the flow meter (21). Then the temperature difference signal will be used to adjust a flow set point upward or downward, based on the selected temperature difference range. The temperature difference control range as an example may have a high temperature of 10 degrees F. and a low temperature of 9.75 degrees F. The flow set point would be adjusted up or down by a fixed increment of flow which is established by the chiller plant's initial design. It is also desired that the flow rate though the condenser not be allowed to fall below a minimum flow rate to prevent fouling of the condenser tubes, and to maintain flow at or above the chiller manufacturer's minimum flow requirements. The computerized controller (25*a*) compares a minimum flow rate set point to the said flow rate signal and prevents the flow rate from being reduced below this minimum value, which is easily determined from the manufacturer's published literature.

The computerized controller (25*a*) will also control the speed of the cooling tower fan (6). The entering cooling fluid temperature and the flow rate signal will be evaluated by the computerized controller to determine the appropriate cooling tower fan speed. Control output signals are then generated and sent to the variable speed electric motor (7) for the cooling tower fan (6). The temperature of the cooling fluid entering the condenser (4) is compared to the design cooling fluid temperature for the cooling tower, at the maxim outdoor design conditions. As long as the entering cooling fluid temperature is at or above the design cooling fluid temperature, the cooling tower fan will be maintained at full speed. When the entering temperature of cooling fluid temperature falls below the design cooling fluid temperature by a fixed value, the cooling tower fan speed is then controlled with respect to the cooling fluid flow rate signal provided by flow meter (21). A fixed relationship will be established, depending on plant design and configuration, to control the fan speed to flow rate signal. An example relationship is Fan Speed %=1.5×Actual Flow Rate %−Constant. Where the constant can be any value between 0 & 50, and the upper limit on Fan Speed is fixed. Also minimum basin temperature values and any condenser water reset values that might ordinarily be designed into a cooling tower system will also be accommodated within the control structure. It is also anticipated that it may be desirable to control the fan speed in multiple steps where the next lower step is only allowed over a selected time period to maintain a more stable system operation.

The set point value for the chilled fluid temperature is a readily accessible input provided by the chiller manufacturer. The computerized controller (25*b*) will provide a signal output to adjust the chiller set point. The heat rejection rate of the chiller will be evaluated for each chiller then an appropriate set point value will be generated for that chiller. The BTU rate signal provides the heat rejection rate for each chiller. Using the chiller manufacturers published data and curves for chiller part load efficiency, it is possible to relate the heat rejection rate to the chiller load rate. The chiller plant operator may determine, that a simple formula that allows resetting the chiller set point in direct proportion to the heat rejection rate, be the preferred method of operation. The chiller plant operator may, particularly where there are multiple large chillers involved, use operating curves developed for each chiller to determine the best set point for each operating chiller, where one chiller may have a set point different then the next operating chiller.

Figure 4:
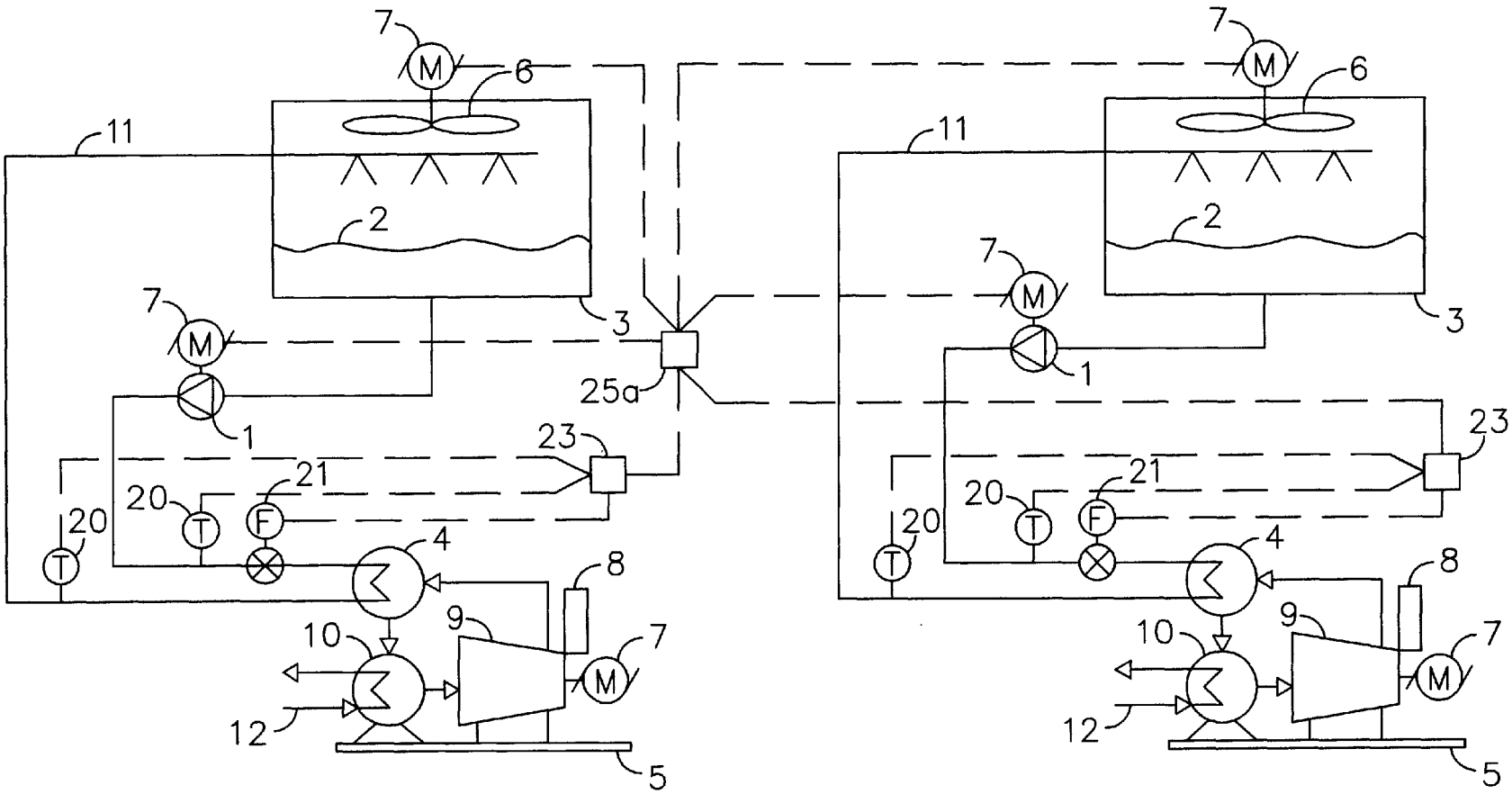
FIG. 4 shows a similar but simpler invention that controls the operation of cooling tower fans and cooling fluid pumps.
Figure 5:
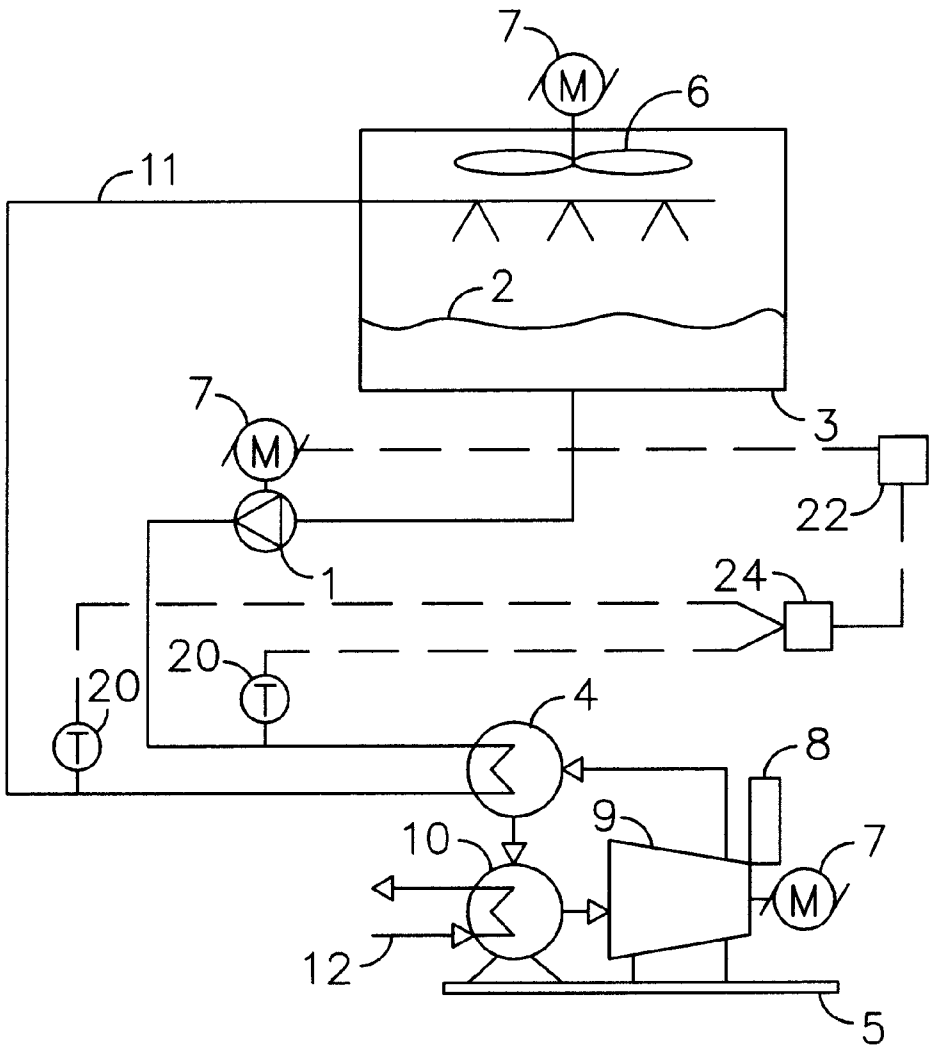
FIG. 5 shows a similar but even simpler invention that controls the operation of only the cooling fluid pump.

FIGS. 4–5 Alternative Embodiments

Alternative embodiments are show in FIGS. 4 and 5. The present invention is applicable to the control of cooling fluid pumps and cooling tower fans without coordinating the chiller operation at the same time. FIG. 4 shows that computerized controller (25*a*) and its related functions can adequately manage a chiller plant that does not require the full implementation shown in the main embodiment. Another alternative embodiment where the cooling fluid piping circuit (11) is combined into one circuit for multiple chillers. This variation in chiller plant design would require the addition of a control valve at each refrigerant condenser (4) for each chiller (5), which is easily accommodated by this invention.

Furthermore FIG. 5 shows an additional embodiment that will allow application when it is desired to only control the cooling fluid pump. A matched pair of temperature sensors (20) are installed in the cooling fluid piping circuit (11) such that the entering cooling fluid temperature and the leaving cooling fluid temperature at the refrigerant condenser (4) are accurately measured. A differential temperature transmitter (24) receives the temperature signals from each temperature sensor (20). The temperature difference signal is sent to a temperature controller (22) which provides the control output signal for the electric motor drive (7) of the pump (1). A low flow limit to protect the refrigerant condenser (4) will be established with manual balancing during commissioning, then a fixed low limit operating point is programed into the variable speed electric motor drive (7).

Advantages

From the description above, my method to optimize a chiller plant operation has a number of advantages:

(a). A simple method to control and reduce the pumping energy in the heat rejection circuit of a chiller, with the installation of matched temperature sensors in the fluid cooling loop near the refrigerant condenser, and a basic control circuit for the cooling fluid pump.

(b) Additional control for the cooling tower fan speed is easily combined in a synergistic way to substantially increase energy savings for a small incremental cost in control functionality.

(c) Additional capability to include sequencing and set point adjustment for the operating chillers in a multiple chiller plant provides the plant operator with a flexible method that can be easily customized to any chiller plant operation thus providing additional energy savings.

(d) The method disclosed above can be easily applied to chiller plants where the chillers pumps and cooling towers all vary in size and capacity, and where all of the chillers and pumps and cooling towers share one heat rejection piping circuit.

(e) Many existing chiller plants can be easily retrofitted with this control method.

(f) The engineer, or the contractor can easily install and configure my invention without requiring the intervention of a specialist in computer controls or special knowledge of chiller control or operation.

Conclusions, Ramifications and Scope

The reader can see that the present method is straight forward and uncomplicated. Engineers and technicians with a general knowledge of the art will have no difficulty implementing and incorporating my method, making it more likely that it will be used in a larger number of applications, creating substantial energy savings. The energy savings are significant as a percent of the overall chiller plant energy usage and tend to be synergistic. When a chiller is operating at partial load it does not reject as much heat, reducing the need for cooling fluid. By allowing the flow rate to reduce instead of the temperature difference across the condenser, pump energy is reduced. Also reducing the flow rate improves the performance of the cooling tower, by reducing the cooling fluid temperature, which in turn may improve the efficiency of the chiller. Further reduction in heat rejection load and reducing flow rate, leaves the cooling tower with excess fan capacity that can not be regained to provide additional cooling, therefore reducing the fan speed in a controlled manner will not effect the performance of the cooling tower but, will reduce the energy used by the fan. Much of the energy savings are developed by coordinating the pump and cooling tower operation to the chiller operation. Closer control of chiller operation, changing chilled water temperature set point based on load, will provide some additional energy savings.

While my above description contains many specificities, these should not be construed as limitations on the scope of the invention, but rather as an exemplification of selected embodiments thereof. Many other variations are possible. For example

- the use of an instrument, may be replaced by a transmitter specifically designed for this application.
- the temperature difference may be calculated by the computerized controller, in place of an instrument receiver.
- the use of a proportional control loop in place of a PID loop to control the variable speed motor drives.
- the use of an industry standard "Programmable Logic Controller" in place of the computerized controller.
- the use of a "Building Automation System" in place of the computerized controller to provide some or all control functions and outputs described in the above invention.
- the use of additional control logic to improve system stability or provide greater energy savings.
- the use of differential pressure sensing devices to determine flow rate in place of the flow meter.

Accordingly, the scope of the invention should be determined not by the embodiments illustrated, but by the appended claims and their legal equivalents.

I claim:

1. A method to optimize a chiller plant, that reduces overall energy use, comprising:

(a) a first means for measuring temperature difference of a cooling fluid entering and leaving a condenser of a chiller, (b) a second means for providing a predetermined temperature difference set point, thereby providing a constant temperature difference demand between said cooling fluid entering and leaving said condenser of said chiller during any operating condition of said chiller, (c) a third means for controlling flow rate of said cooling fluid to maintain the cooling fluid temperature at said predetermined set point, whereby the reduction of pumping energy is larger then the increase in energy use of said chiller and a cooling tower of said chiller plant so that the total energy use of said chiller plant is reduced without changing the refrigeration output of said chiller.

2. The method of claim 1 wherein:

(a) said first means for measuring temperature difference includes at a minimum, two temperature sensors, with one temperature sensor located in said cooling fluid entering said chiller condenser, and one temperature sensor located in said cooling fluid leaving said chiller condenser, (b) said first means for measuring temperature difference includes a temperature receiver/transmitter to receive temperature signals and provides real time temperature difference values, (b) said second means for providing a predetermined temperature difference set point, includes a unitary temperature controller to maintain the predetermined difference temperature between said cooling fluid entering and leaving said condenser of said chiller during any operating condition of said chiller.

3. The method of claim 1, wherein:

(a) said third means includes a control output to a fluid flow control device located in a piping circuit of said cooling fluid, whereby said fluid flow control device controls said flow rate.

4. The method of claim 1, wherein (a) said third means includes a varying control output or changing control set points for an electric motor drive of a condenser water pump of said chiller plant to control said flow rate.

5. The method of claim 1, further including:

(a) a fourth means for measuring cooling fluid flow rate, (b) a fifth means for calculating a set point for said flow rate that is a function of said predetermined temperature difference set point, (c) a sixth means for providing said set point for said flow rate as input to standard proportional, integral, and derivative control algorithms, (d) a seventh means for providing a control output from said standard proportional, integral, and derivative control algorithms as a varying control output or changing control set points for an electric motor drive of a condenser water pump of said chiller plant to control said flow rate.

6. The method of claim 1, further including:

(a) an eighth means for measuring a flow rate of cooling fluid entering a condenser of said chiller and providing said flow rate to a computerized controller, (b) a ninth means for providing a maximum fan speed set point of a fan or fans of a cooling tower of said chiller plant, whereby said computerized controller compares actual flow rate to a predetermined maximum flow rate and determines said maximum fan speed set point as a function of the difference between said predetermined maximum flow rate and said actual flow rate, (c) a tenth means for adjusting said maximum fan speed set point as a function of said flow rate, whereby the reduction in the energy use of the fan is greater then the increase in energy use of said chiller so that the total energy use of said chiller plant is reduced without changing the refrigeration output of said chiller.

7. The method of claim 6, further including:

(a) a eleventh means for measuring a temperature of said cooling fluid, (b) a twelfth means providing for a predetermined temperature set point for said cooling fluid, (c) an thirteenth means for comparing said temperature to said predetermined set point, (d) an fourteenth means for controlling the fan speed to maintain said temperature at or near said set point while not exceeding said maximum fan speed set point, (e) a fifteenth means for calculating a second temperature set point for said cooling fluid as a function of said flow rate and adjusting a controlling temperature set point to match said second temperature set point, whereby the reduction in the energy use of said chiller is greater then the increase in energy use of said cooling tower so that the total energy use of said chiller plant is reduced without changing the refrigeration output of said chiller.

8. The method of claim 6, further including:

(a) an sixteenth means for providing a chilled water temperature set point adjustment value to said chiller, (b) a seventh means for calculating the chilled water set point adjustment as a function of said flow rate, whereby the energy use of said chiller is reduced without changing the refrigeration output of said chiller.

9. A method to optimize a chiller plant, that reduces overall energy use, comprising:

(a) a first means for measuring a flow rate of cooling fluid entering a condenser of a chiller of said chiller plant, (b) a second means for providing a maximum fan speed set point of a fan or fans of a cooling tower of said chiller plant, (c) a third means for adjusting said maximum fan speed set point as a function of said flow rate, whereby the reduction in the energy use of the fan is greater then the increase in energy use of said chiller so that the total energy use of said chiller plant is reduced without changing the refrigeration output of said chiller.

10. The method of claim 9, wherein:

(a) said first means for measuring said flow rate also provides flow rate values to a computerized controller, (b) said computerized controller compares actual flow rate to a predetermined maximum flow rate and determines said maximum fan speed set point as a function of the difference between said predetermined maximum flow rate and said actual flow rate.

11. The method of claim 9, further including:

(a) a fourth means for measuring a temperature of said cooling fluid, (b) a fifth means providing for a predetermined temperature set point for said cooling fluid, (c) an sixth means for comparing said temperature to said predetermined set point, (d) an seventh means for controlling the fan speed to maintain said temperature at or near said set point while not exceeding said maximum fan speed set point, (e) a eighth means for calculating a second temperature set point for said cooling fluid as a function of said flow rate and adjusting a controlling temperature set point to match said second temperature set point, whereby the reduction in the energy use of said chiller is greater then the increase in energy use of said cooling tower so that the total energy use of said chiller plant is reduced without changing the refrigeration output of said chiller.

12. The method of claim 9, further including:

(a) an ninth means for providing a chilled water temperature set point adjustment value to said chiller, (b) a tenth means for calculating the chilled water set point adjustment as a function of said flow rate, whereby the energy use of said chiller is reduced without changing the refrigeration output of said chiller.

13. A Chiller Plant Optimizer comprising:

(a) a computerized controller for calculating a temperature difference between the entering and leaving temperatures of a cooling fluid that flows through a condenser of a chiller of a chiller plant and, (b) said computerized controller for comparing the actual temperature difference of said cooling fluid to a predetermined temperature difference of said cooling fluid and, (c) said computerized controller for calculating a control output signal as a function of the calculated difference between said actual temperature difference and said predetermined temperature difference, thereby controlling a flow rate of said cooling fluid to maintain the cooling fluid temperature difference at or near said predetermined temperature difference, whereby the reduction of energy use by a cooling fluid pump of said chiller plant is greater then the increase in energy use of said chiller and a cooling tower of said chiller plant so that the total energy use of said chiller plant is reduced without changing the refrigeration output of said chiller.

14. The Chiller Plant Optimizer of claim 13, further including:

(a) a plurality of temperatures sensors located in a cooling fluid piping circuit of a chiller plant to measure temperatures of said cooling fluid entering and leaving said condenser and, (b) an instrument receiver for powering sensors, regularizing sensor output signals, and determining actual temperatures of said cooling fluid.

15. The Chiller Plant Optimizer of claim 13, further including:

(a) a flow meter for measuring flow rate of said cooling fluid, (b) said computerized controller for calculating a flow rate set point as a function of said actual temperature difference and said predetermined temperature difference, thereby controlling said flow rate of said cooling fluid to maintain said cooling fluid temperature difference at or near said predetermined temperature difference.

16. The Chiller Plant Optimizer of claim 13, further including:

(a) said computerized controller for calculating a maximum fan speed set point of a fan or fans of a cooling tower of said chiller plant as a function of the difference between said actual flow rate and a predetermined maximum flow rate of said cooling fluid, (b) said computerized controller for providing said maximum speed set point of an electric motor drive of fan of said cooling tower, whereby the reduction in the energy use of the fan is greater then the increase in energy use of said chiller so that the total energy use of said chiller plant is reduced without changing the refrigeration output of said chiller.

17. The Chiller Plant Optimizer of claim 13, further including:

(a) said computerized controller for calculating said temperature difference of cooling fluid, provides temperature of cooling fluid entering said condenser, (b) said computerized controller for providing a predetermined temperature set point for said cooling fluid, (c) said computerized controller for comparing said temperature of said cooling fluid entering said condenser to said predetermined set point, (d) said computerized controller for controlling the fan speed to maintain said temperature at or near said set point while not exceeding said maximum fan speed set point, (e) said computerized controller for calculating a second temperature set point for said cooling fluid as a function of said flow rate and adjusting a controlling temperature set point to match said second temperature set point, whereby the reduction in the energy use of said chiller is greater then the increase in energy use of said cooling tower so that the total energy use of said chiller plant is reduced without changing the refrigeration output of said chiller.

* * * * *

UNITED STATES PATENT AND TRADEMARK OFFICE

CERTIFICATE OF CORRECTION

PATENT NO. : 6,718,779 B1
DATED : April 13, 2004
INVENTOR(S) : William R. Henry

It is certified that error appears in the above-identified patent and that said Letters Patent is hereby corrected as shown below:

Column 3,
Lines 16-18, Objects and Advantages, paragraph (c) change "based on the cooling fluid temperatures and cooling fluid flow rate." to -- based on the cooling fluid flow rate. --

Column 4,
DESCRIPTION, third paragraph and nearest lines 48/49, change "A BTU meter" to -- An instrument receiver --
Reference Numerals, make the following changes:

a. Nearest line 13, add the missing reference number -3- in front of list item "cooling tower".
b. Next item, change reference number "3" to -4- in front of list item "refrigerant condenser".
c. Next item, change reference number "4" to -5- in front of list item "chiller".
d. Next item, change reference number "5" to -6- in front of list item "fan".
e. Next item, change reference number "6" to -7- in front of list item "electric motor drive".
f. Next item, change reference number "7" to -8- in front of list item "chiller control panel".
g. Next item, change reference number "8" to -9- in front of list item "refrigerant compressor".
h. Next item, change reference number "9" to -10- in front of list item "refrigerant evaporator".
i. Next item, change reference number "10" to -11- in front of list item "cooling fluid piping circuit".
j. Next item, change reference number "11" to -12- in front of list item "chilled fluid piping circuit".
k. Next item, change reference number "12" to -13- in front of list item "computerized controller".
l. Next item, change reference number "13" to -20- in front of list item "temperature sensor".
m. Next item, change reference number "20" to -21- in front of list item "flow meter".

Signed and Sealed this

Twenty-ninth Day of June, 2004

JON W. DUDAS
*Acting Director of the United States Patent and Trademark Office*